US010487466B1

(12) United States Patent
Belter

(10) Patent No.: US 10,487,466 B1
(45) Date of Patent: Nov. 26, 2019

(54) HAND OPERABLE WASTE COLLECTION DEVICE AND METHOD THEREFOR

(71) Applicant: Randall Belter, Green Bay, WI (US)

(72) Inventor: Randall Belter, Green Bay, WI (US)

( * ) Notice: Subject to any disclaimer, the term of this patent is extended or adjusted under 35 U.S.C. 154(b) by 0 days.

(21) Appl. No.: 16/395,906

(22) Filed: Apr. 26, 2019

(51) Int. Cl.
*E01H 1/12* (2006.01)
*A01K 29/00* (2006.01)

(52) U.S. Cl.
CPC ..... *E01H 1/1206* (2013.01); *E01H 2001/126* (2013.01)

(58) Field of Classification Search
CPC ..... E01H 1/1206; E01H 2001/1226; E01H 2001/126; A01K 23/005
USPC ..... 294/1.3
See application file for complete search history.

(56) References Cited

U.S. PATENT DOCUMENTS 3,685,088 A * 8/1972 Doherty ..... E01H 1/1206 294/1.3
3,857,597 A * 12/1974 Young ..... E01H 1/1206 294/1.3
3,885,266 A 5/1975 Natziger
4,155,581 A 5/1979 Kanaga
4,247,139 A * 1/1981 Grieb ..... E01H 1/1206 294/1.4
5,964,488 A * 10/1999 Bedel ..... E01H 1/1206 15/257.6
6,247,735 B1 6/2001 Berkman
7,665,780 B2 10/2010 Vollmer
8,403,386 B2 * 3/2013 Hoffman ..... E01H 1/1206 294/1.3
8,708,381 B2 * 4/2014 Chongtoua ..... A01K 1/0125 15/257.6
2004/0222650 A1 * 11/2004 Colesanti ..... E01H 1/1206 294/1.3
2006/0279097 A1 * 12/2006 Jones ..... E01H 1/1206 294/1.3

FOREIGN PATENT DOCUMENTS

CA 2667248 A1 11/2010
EP 1283305 A1 * 2/2003 ..... E01H 1/1206
EP 2520720 A2 11/2012
FR 2686634 A1 * 7/1993 ..... E01H 1/1206
WO 2010/010212 A1 2/2010

* cited by examiner

*Primary Examiner* — Dean J Kramer
(74) *Attorney, Agent, or Firm* — Bendel IP Legal LLC

(57) ABSTRACT

A hand operable waste collection device includes first and second box portions joined along a first hinge. A first flange is joined to first box portion along a second hinge and a first flange body portion extends away from second hinge and the body portion may have a first flange end portion with a hole therein. In a collection mode: the first and second box portions are in an expanded position, the first and second hinges are spaced from each other, the first flange is rotatable about the second hinge to position the first flange body portion next to the first box portion, and the first and second box portions are rotatable relative to one another about the first hinge from an open collection state to a closed collection state to trap waste therein. The second hinge is next to the second box portion in the closed collection state.

50 Claims, 10 Drawing Sheets

HAND OPERABLE WASTE COLLECTION DEVICE AND METHOD THEREFOR

TECHNICAL FIELD

This invention relates to the collection of waste, such as pet waste, from a surface, and more particularly, the invention is directed to a hand operable waste collection device for easy operation, collection and disposal of the waste and collection device itself when desired.

BACKGROUND

The collection and disposal of waste, for example that of animals and in particular that of pets, has been an undesirable but necessary duty for many years. Several inventors have attempted to address this problem in a wide variety of ways ranging from use of a simple scoop or bag to relatively complex contraptions with many moving parts, as described in prior art references. Many of these devices may not be acceptable to some persons, may not be practical, or may be too complex or expensive for the use made of them. For instance, the use of a plastic bag to retrieve pet feces can present an unpleasant tactile sensation to the user, even though the user is separated from the waste by the thickness of the plastic bag. This unpleasant tactile sensation can render the plastic bag unacceptable for use by many users. And, most plastic bags are not readily suited for environmentally friendly disposal such as composting. In other instances, a variety of waste collecting devices may include long handles and the like rendering them less than portable or versatile for everyday usage and a wide variety of users.

In the last several decades, it has now come to pass that through either legal, ethical or moral requirements, disposal of waste, e.g., that of pets, in a clean and convenient manner is desired, if not required. Notwithstanding the aforesaid uses, the subject invention is also suitable for alternative similar uses such as the removal of vomit and other biological, or chemical waste. In the disposal of undesirable waste products, it is particularly desirable to isolate the waste from contact with the person performing the disposing process. In addition, the device used to remove the waste may become soiled or contaminated posing an unsanitary condition in and of itself. It is therefore desired to have the ability to obtain an inexpensive, disposable receptacle which effectively isolates the receptacle's contents from the hand of the user, and which in total can then be disposed of, preferably in an environmentally friendly manner. The present invention is directed to solve one or more of the problems set forth above, and doing so in a new and/or more effective way(s).

SUMMARY

To address one or more of the above described needs, or as may be discovered through use and practice of the subject invention, there is provided a hand operable waste collection device. The collection device includes a first box portion joined to a second box portion along a first hinge therebetween. The device also includes a first flange joined to the first box portion along a second hinge therebetween, the first flange having a first flange body portion extending away from the second hinge and a first flange end portion outward of the first flange body portion. The device further includes a second flange joined to the second box portion along a third hinge therebetween, the second flange having a second flange body portion extending away from the third hinge and a second flange end portion outward of the second flange body portion. The waste collection device in a collection mode includes (i) the first box portion and the second box portion in an expanded position, (ii) the first hinge and the second hinge spaced from each other and the first hinge and the third hinge spaced from each other, (iii) the first flange body portion positionable facing and co-planar with the first box portion, (iv) the second flange body portion positionable facing and co-planar with the second box portion, (v) the first box portion and the second box portion being rotatable relative to one another about the first hinge from an open collection state to receive waste and a closed collection state to trap waste in between the first box portion and the second box portion, and (vi) the second hinge and the third hinge positioned next to each other in the closed collection state.

In another embodiment of the invention, the hand operable waste collection device includes a first box portion joined to a second box portion along a first hinge therebetween. The device also includes a first flange joined to the first box portion along a second hinge therebetween, the first flange having a first flange body portion extending away from the second hinge. The device further includes a second flange joined to the second box portion along a third hinge therebetween, the second flange having a second flange body portion extending away from the third hinge. The waste collection device has a collection mode in which (i) the first box portion and the second box portion are in an expanded position, (ii) the first hinge and the second hinge are spaced from each other and the first hinge and the third hinge are spaced from each other, (iii) the first box portion and the second box portion being rotatable relative to one another about the first hinge from an open collection state to receive waste and a closed collection state to trap waste in between the first box portion and the second box portion, (iv) the first flange body portion is rotatable relative to the first box portion about the second hinge in a first arc of at least 100 degrees to move away from and next to the first box portion, (v) the second flange body portion is rotatable relative to the second box portion about the third hinge in a second arc of at least 100 degrees to move away from and next to the second box portion and (vi) the second hinge and the third hinge are positioned next to each other in the closed collection state.

In yet another embodiment, the hand operable waste collection device includes a first box portion joined to a second box portion along a first hinge therebetween. The device also includes a first flange joined to the first box portion along a second hinge therebetween, the first flange having a first flange body portion extending away from the second hinge, a first flange end portion being outward of the first flange body portion, a hole located in the first flange end portion and the hole sized to receive one or more finger or thumb therein. The waste collection device in a collection mode includes (i) the first box portion and the second box portion being in an expanded position, (ii) the first hinge and the second hinge being spaced from each other, (iii) the first flange being rotatable about the second hinge to position the first flange body portion next to the first box portion, (iv) the first box portion and the second box portion being rotatable relative to one another about the first hinge from an open collection state to receive waste and a closed collection state to trap waste in between the first box portion and the second box portion, and (v) the second hinge next to the second box portion in the closed collection state.

In a different embodiment of the invention there is a method of collecting waste with a hand operable waste collection device. The method includes providing a waste collection device having a first box portion joined to a second box portion along a first hinge therebetween, a first flange joined to the first box portion along a second hinge therebetween with a first flange body portion extending away from the second hinge, and a second flange joined to the second box portion along a third hinge therebetween with a second flange body portion extending away from the third hinge. The method then includes expanding the first box portion and the second box portion into a collection mode where the first hinge and the second hinge are spaced from each other and the first hinge and the third hinge are spaced from each other. Next, the method includes rotating the first flange relative to the first box portion about the second hinge to move the first flange body portion next to the first box portion. And then, the method can include rotating the second flange body portion relative to the second box portion about the third hinge to move the second flange body portion next to the second box portion. After one or both of the prior two steps, then rotating the first box portion and the second box portion relative to one another about the first hinge from an open collection state to receive waste and a closed collection state to trap waste in between the first box portion and the second box portion. Finally, the method includes locating the second hinge and the third hinge next to each other in the closed collection state, thereby trapping the waste inside the collection device.

In some embodiments at least one of the first flange end portion and the second flange end portion has a hole located therein and the hole is sized to receive one or more finger or thumb therein.

In some embodiments the collection device is preferably held in one hand and is operable between the open collection state and the closed collection state with use of that same hand.

In some embodiments the first flange body portion is positioned facing and touching the first box portion and/or the second flange body portion is positioned facing and touching the second box portion.

In some embodiments the waste collection device is in a storage mode. The storage mode includes the first box portion and the second box portion in a collapsed position. The first flange body portion can be positioned co-planar with the second box portion. The second flange body portion can be positioned co-planar with the second box portion. And, the first flange body portion can be positioned facing and co-planar with the second flange body portion.

Other embodiments concern additional features to enhance the storage mode, for example, the configuration and/or orientation of the first flange body portion, the second box portion, elongated box sides, and these parts relative to themselves and/or relative to each other.

In some embodiments the waste collection device is in a disposal mode. The disposal mode includes the first box portion and the second box portion in the expanded position and in the closed collection state to trap waste in between the first box portion and the second box portion. The first flange body portion can be positioned facing and co-planar with the second flange body portion and at least one the first flange body portion and the second flange body portion spaced from at least one of the first box portion and the second box portion.

Other embodiments concern additional features to enhance the disposal mode, for example, the configuration of the first flange body portion and the second flange body portion, a tab receptacle and a tab where the tab is positioned into the tab receptacle to hold the first flange body portion facing the second flange body portion and/or to further hold the second hinge and the third hinge positioned next to each other in the closed collection state.

Also described herein are features of the invention when in the expanded position, and directed to the configuration and/or orientation of: a first box vertex, a second box vertex, the first flange end portion and the second flange end portion, for these relative to each other and/or to the first hinge, the second hinge, and/or the third hinge, including when rotatable rotatable from the open collection state to the closed collection state.

In some embodiments of the method of the invention, rotating the first flange and the second flange includes at least one of the first flange and the second flange rotating in an arc of at least 100 degrees relative to their respective first or second box portion, and preferably at least 180 degrees.

In other embodiments of the method are steps related to positioning the second flange body portion, locating a thumb of a user into the hole of the second flange end portion, positioning the first flange body portion and locating at least one finger of the user into the hole of the first flange end portion. The first flange body portion may be (i) next to and touching or (ii) next to but spaced from, the first box portion. When the first flange body portion is (i) next to and touching the first box portion, then the method can include positioning a different finger of the user against the first hinge, and preferably, using only one hand of the user for rotating the first box portion and the second box portion relative to one another about the first hinge. When the first flange body portion is (ii) next to but spaced from the first box portion, then the at least one finger is also located between the first flange body portion and first box portion.

In some method embodiments, there are additional steps related to the compact packaging of the collection device. These can include collapsing the first box portion and the second box portion. Then, positioning the first flange body portion co-planar with at least one of the first box portion and the second box portion. And finally, positioning the second flange body portion co-planar with at least one of the first box portion and the second box portion.

In some method embodiments, there are aspects related to the locating step. This may include positioning the first flange body portion next to the second flange body portion. And may further include, spacing first flange body portion and the second flange body portion from both the first box portion and the second box portion.

In some method embodiments, there are aspects related to the disposal of the collection device. This includes providing the first flange body portion with a tab receptacle and the second flange body portion with a tab. Next, this can be positioning the tab into the tab receptacle to hold the first flange body portion next to the second flange body portion and the second hinge and the third hinge positioned next to each other in the closed collection state.

BRIEF DESCRIPTION OF THE DRAWINGS

The invention may be more completely understood in consideration of the following detailed description of various embodiments of the invention in connection with the accompanying drawings, in which.

Figure 1:
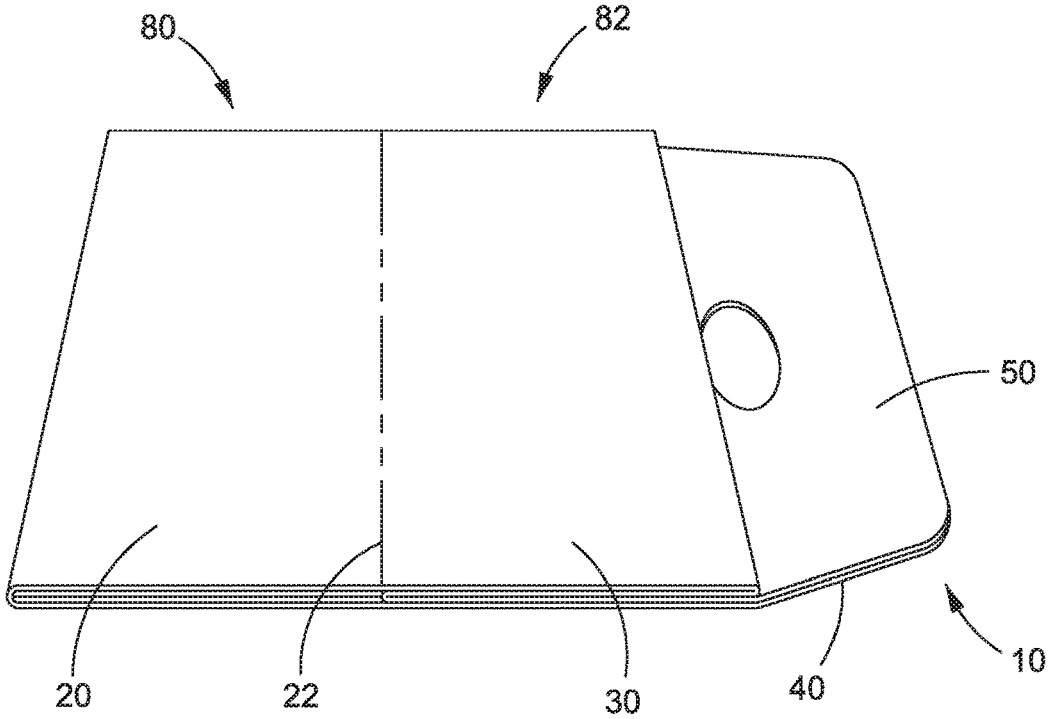
FIG. 1 is a perspective view of an embodiment of the invention in the storage mode.

The drawings show some but not all embodiments. The elements depicted in the drawings are illustrative and not necessarily to scale, and the same (or similar) reference numbers denote the same (or similar) features throughout the drawings.

DETAILED DESCRIPTION

In accordance with the practice of at least one embodiment of the invention, as seen in FIGS. 3 to 9 for ease of discussion, a hand operable waste collection device 10 includes a first box portion 20 joined to a second box portion 30 along a first hinge 22 therebetween. A first flange 40 is joined to the first box portion 20 along a second hinge 42 therebetween. The first flange 40 has a first flange body portion 44 extending away from the second hinge 42. A first flange end portion 46 can be outward of the first flange body portion 44. Desirably but not required, a second flange 50 can be joined to the second box portion 30 along a third hinge 52 therebetween. The second flange 50 has a second flange body portion 54 extending away from the third hinge 52. A second flange end portion 56 can be outward of the second flange body portion 54.

Figure 2:
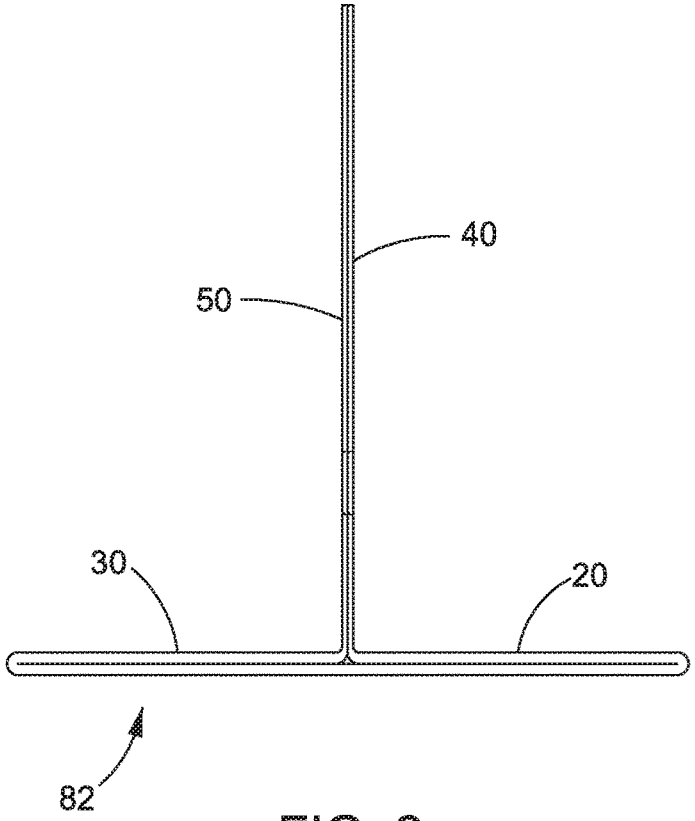
FIG. 2 is an end view of the invention seen in FIG. 1, as it is positionable out of the storage mode toward the collection mode.
Figure 3:
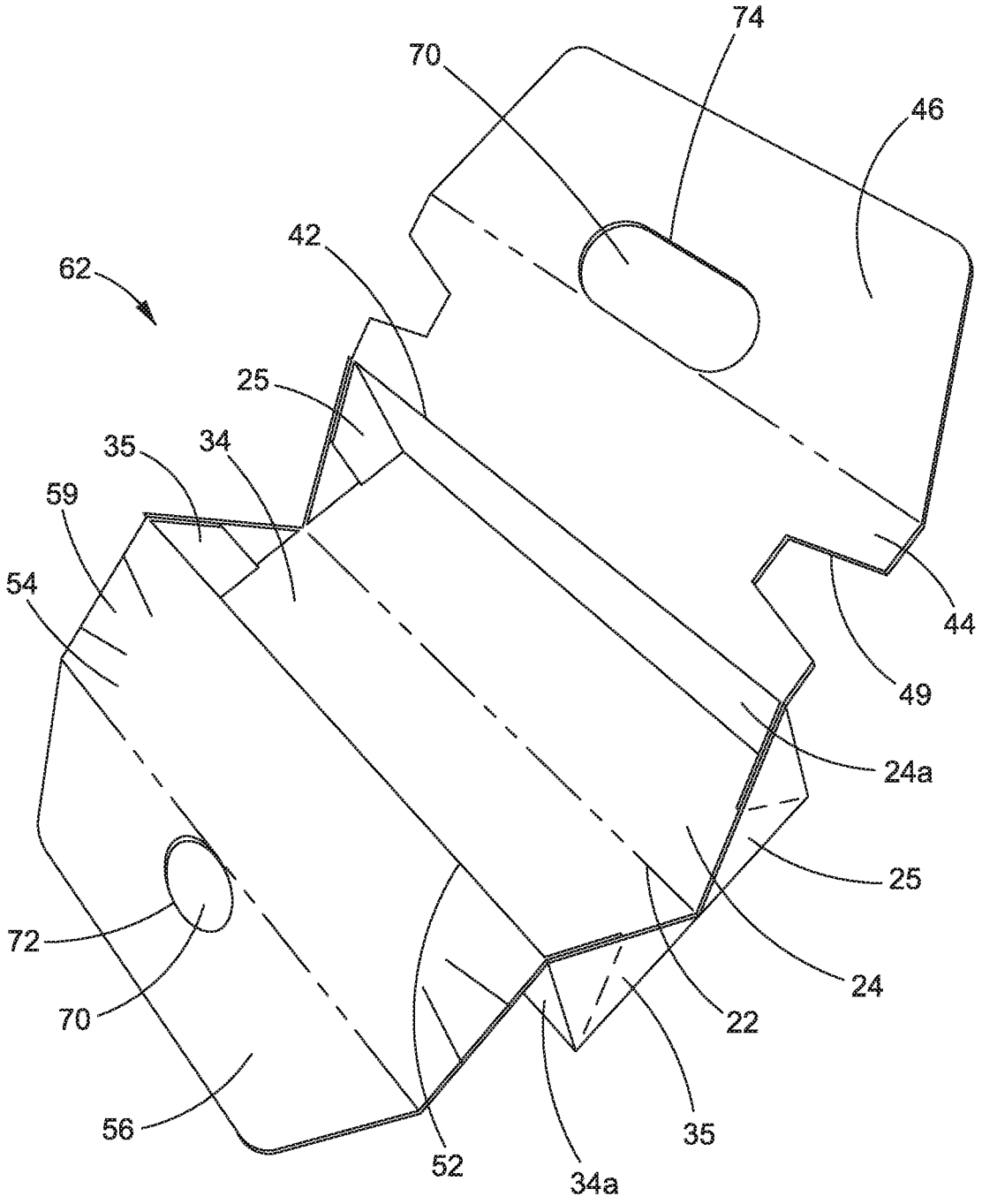
FIG. 3 is a perspective view of the invention seen in FIG. 2, as it is positionable further out of the storage mode and into the collection mode and with the first and second box portions in the expanded position.
Figure 4:
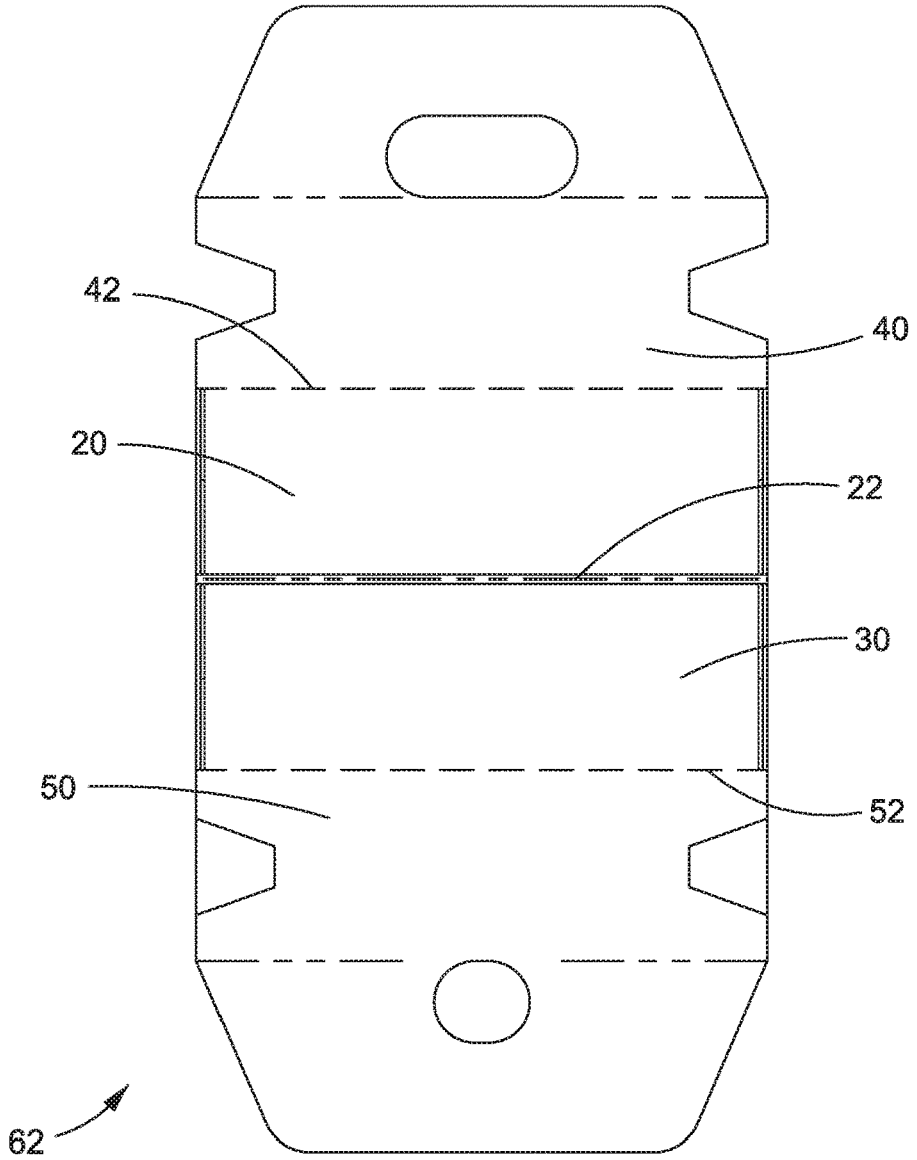
FIG. 4 is a top view of the invention seen in FIG. 3, as it is positionable in the collection mode and with the first and second box portions fully into the expanded position.
Figure 5:
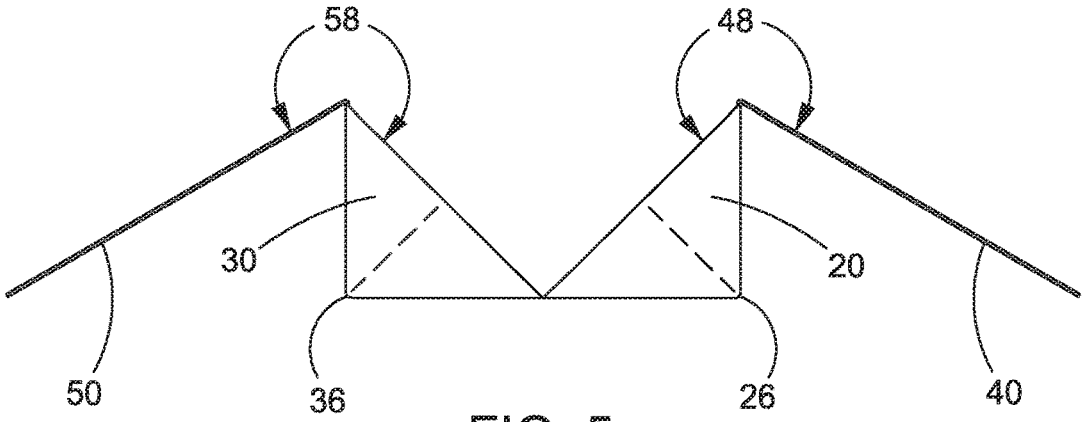
FIG. 5 is an end view of the invention seen in FIG. 4.
Figure 6:
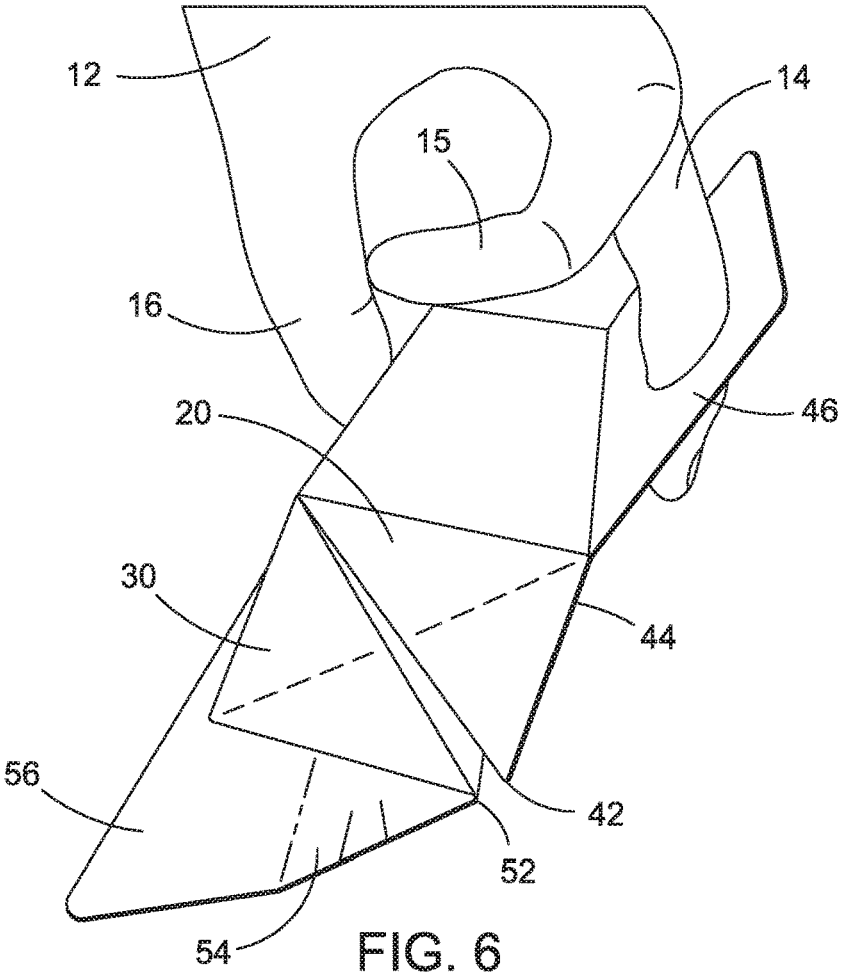
FIG. 6 is a perspective end view of the invention seen in FIG. 5, as the user begins to engage and position their hand with the first flange and mainly the first box portion but also some of the second box portion.
Figure 7:
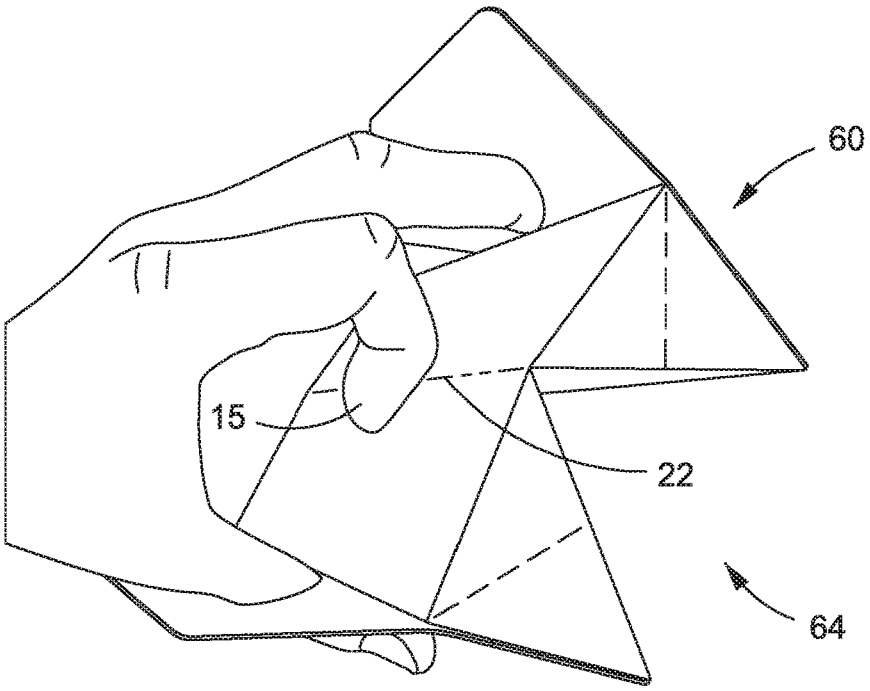
FIG. 7 is a perspective end view of the invention seen in FIG. 6, as the user fully engages their hand with the first flange and now also with the second flange, and the collection device is in the open collection state ready for operation between the open collection state and the closed collection state.
Figure 8:
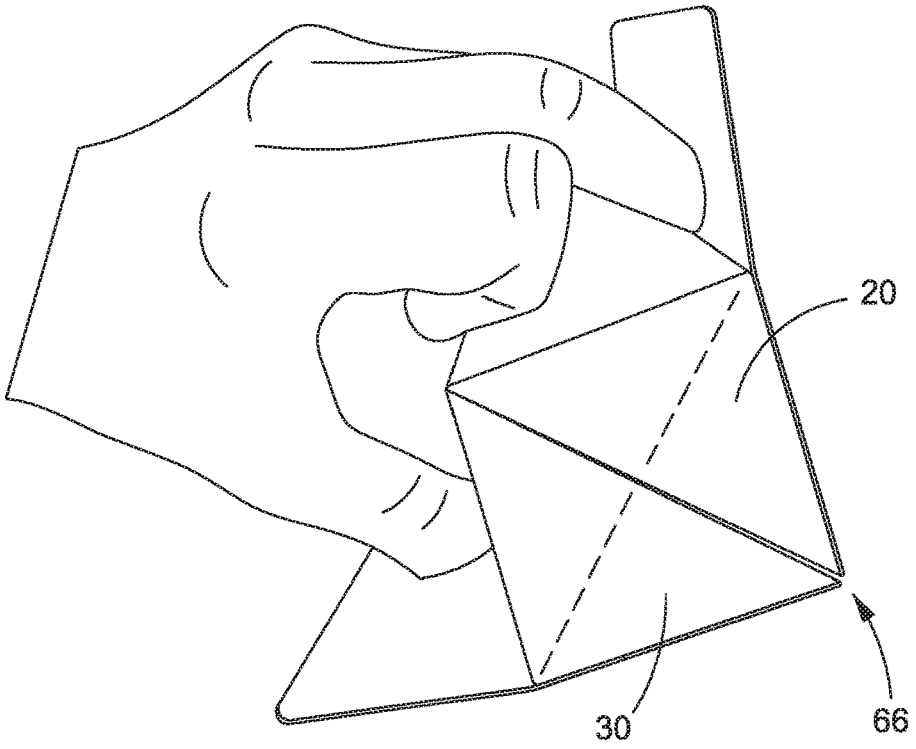
FIG. 8 is a perspective end view of the invention seen in FIG. 7, as the user operates the collection device into the closed collection state.
Figure 9:
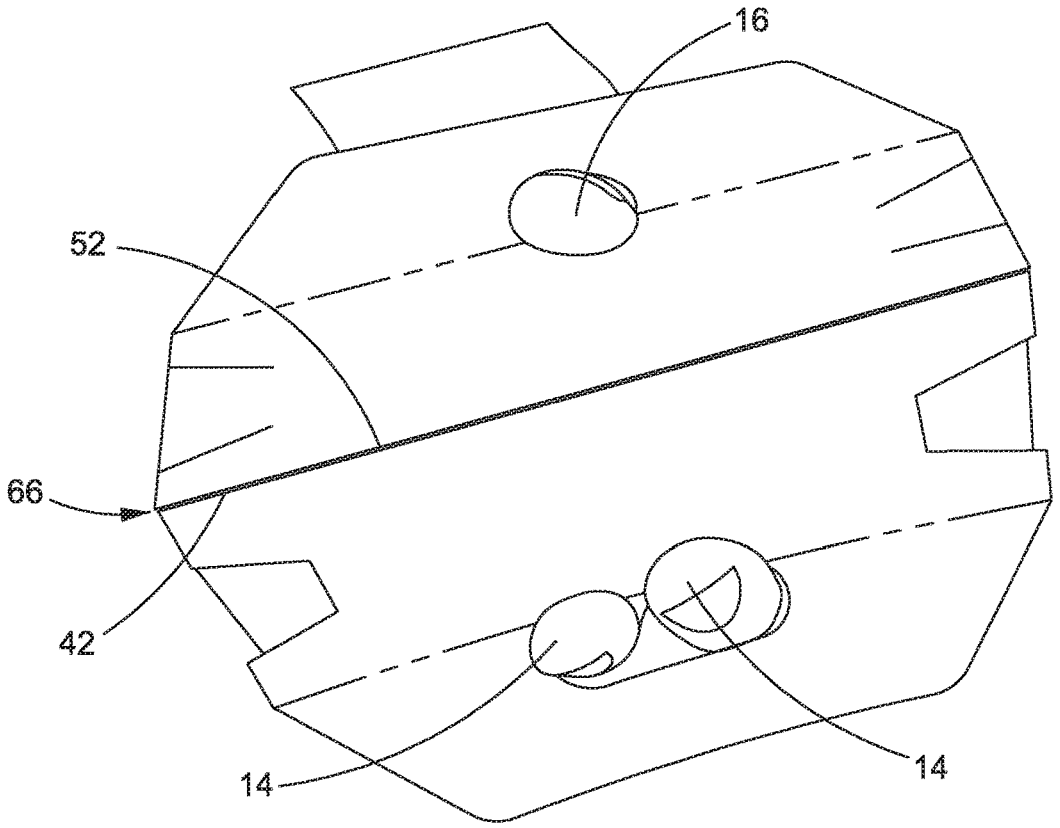
FIG. 9 is a front view of the invention seen in FIG. 8.
Figure 10:
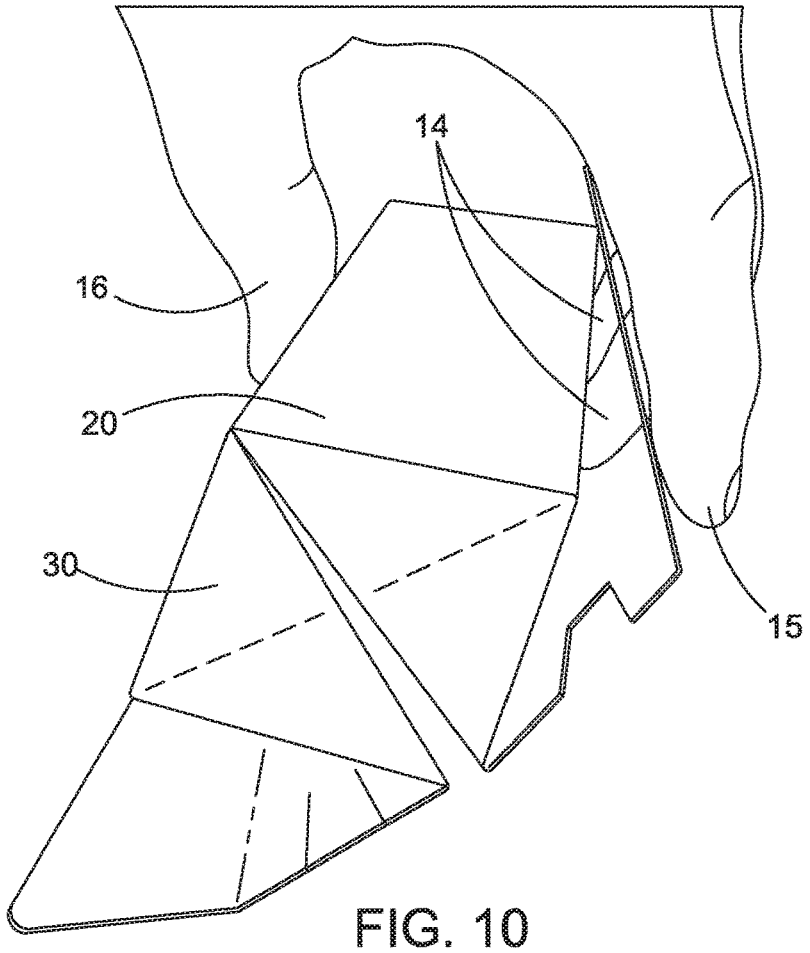
FIG. 10 is a perspective end view of the invention seen in FIG. 5, as the user begins an alternate way to engage and position their hand with the first flange and mainly the first box portion but also some of the second box portion.
Figure 11:
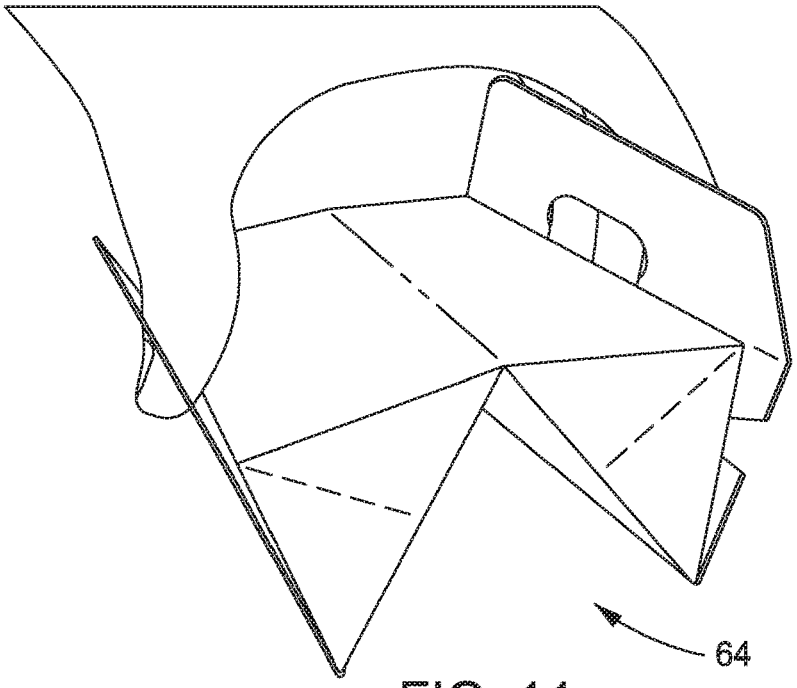
FIG. 11 is a perspective end view of the invention seen in FIG. 10, as the user fully engages their hand with the first flange and now also with the second flange, and the collection device is in the open collection state ready for operation between the open collection state and the closed collection state.
Figure 12:
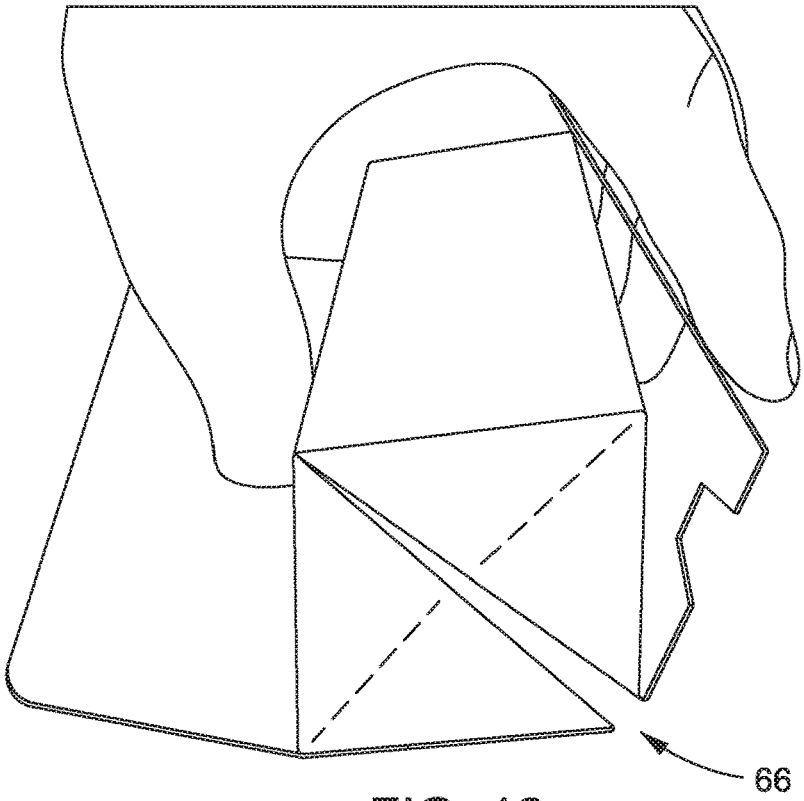
FIG. 12 is a perspective end view of the invention seen in FIG. 11, as the user operates the collection device into the closed collection state.
Figure 13:
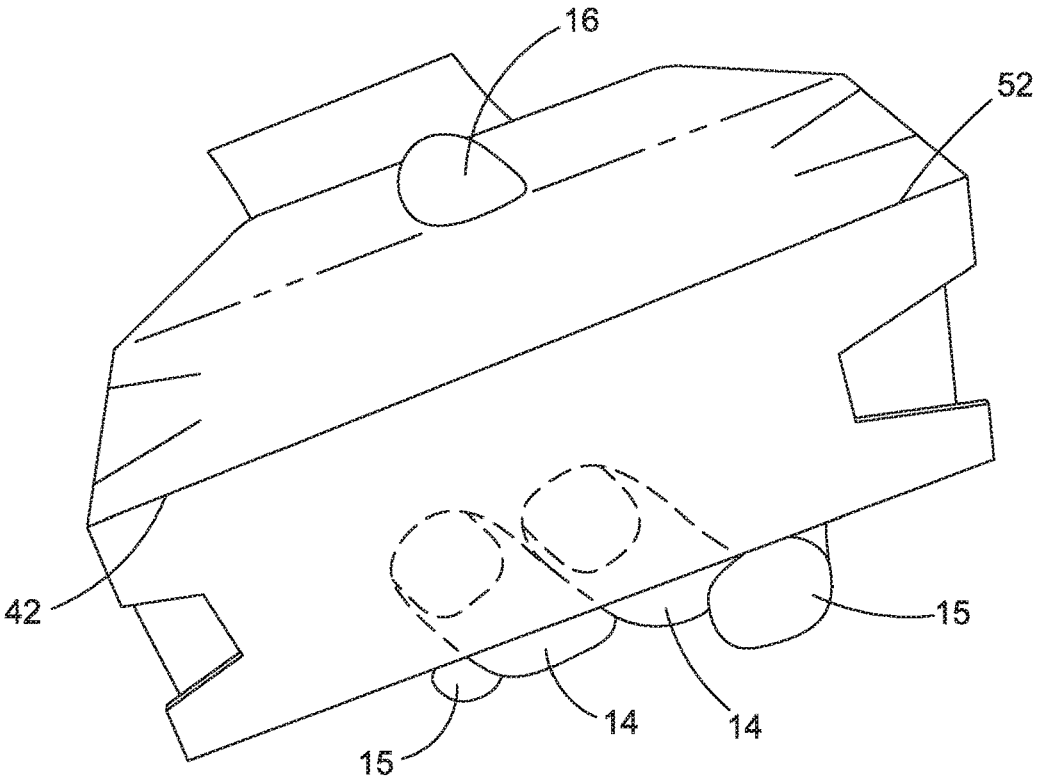
FIG. 13 is a front view of the invention seen in FIG. 12.
Figure 14:
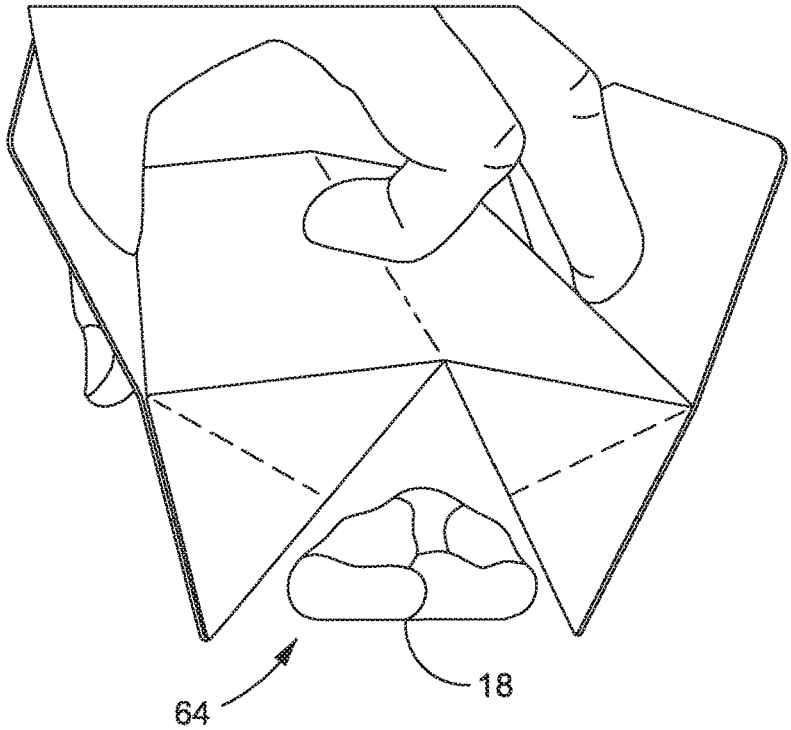
FIG. 14 is an alternate perspective end view of the invention seen in FIG. 7, as it is about to pick up some waste.
Figure 15:
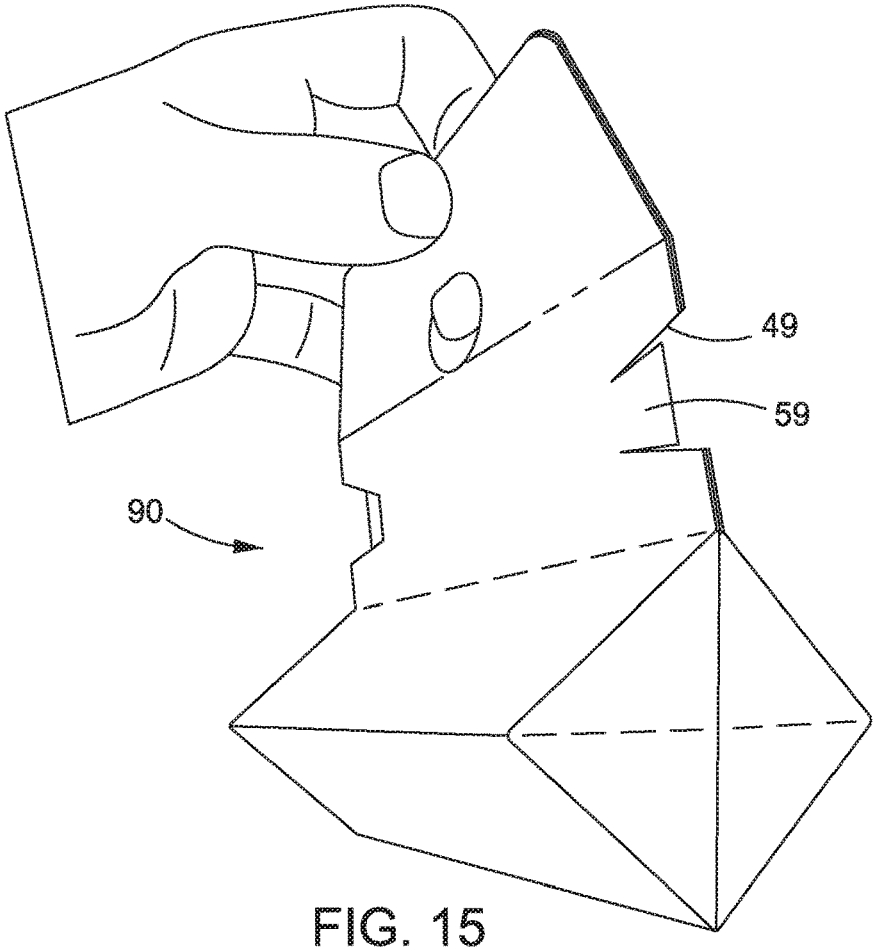
FIG. 15 is a perspective end view of the invention seen in the prior figures, now in the disposal mode.

The waste collection device 10 is positionable through and between three modes. One is collection mode 60 as seen in various states and positions best in FIGS. 3-14 and 18. One is storage mode 80 as seen in FIGS. 1-2. And, one is disposal mode 90 as seen in FIG. 15. In collection mode 60, the first box portion 20 and the second box portion 30 are in an expanded position 62. By expanded, and using the first box portion 20 for reference (where the same applies to second box portion 30 by analogy, for sides 34 (including 34*a*) and ends 35), this means at least one of the sides 24 (including 24*a*) or ends 25 of the first box portion is at least somewhat non-coplanar with another of the sides 24 or ends 25 of the first box portion. Preferably, all of the sides 24 and ends 25 of the first box portion are at least somewhat non-coplanar with the adjoining other sides 24 and ends 25 of the first box portion, in the collection mode. Most preferably, all of the sides 24 and ends 25 of the first box portion are somewhat to completely perpendicular with the adjoining other sides 24 and ends 25 of the first box portion, in the collection mode.

Additional aspects of the collection mode 60 relate to the location and/or positioning of other parts of the collection device 10. For example, the first hinge 22 and the second hinge 42 can be spaced from each other and the first hinge 22 and the third hinge 42, when a second flange is part of the collection device, can be spaced from each other, as seen in FIGS. 3-15 and 17-18. The first flange body portion 44 is rotatable relative to the first box portion 20 about the second hinge 42 in a first arc 48 of at least 100 degrees to move away from and next to the first box portion 20. Similarly, when second flange 50 is part of the collection device, the second flange body portion 54 is rotatable relative to the second box portion 30 about the third hinge 52 in a second arc 58 of at least 100 degrees to move away from and next to the second box portion. As used herein, "next to" means there is no intervening material of the invention between the referenced components or parts of the invention. However, there may be some space or a user or parts of the user, e.g., finger(s) or thumb, between the referenced components of the invention. For each of arc 48 and arc 58, in increasing preference, the arc can be 105 degrees, 110 degrees, and in increments of 5 degrees onward, up to and including 315 degrees. At least in part, it is this range of motion that enables the collection device to be so versatile and operable through the three modes, yet have a relatively simply construction that is easy to use, unlike any prior existing waste collection device. Related to this advantage, the first flange body portion 44 is positionable not only facing, but also co-planar with, the first box portion 20, for example, one of a pair of the elongate first box sides 24 and in particular the side 24*a* that is joined to second hinge 42. Preferably, in one way to use the invention, the first flange body portion 44 is also positionable touching the first box portion, namely side 24*a*. In a similar fashion, the second flange body portion 54 is positionable not only facing, but also co-planar with, the second box portion 30, for example, one of a pair of elongate second box sides 34 and in particular the side 34*a* that is joined to third hinge 52. Preferably, in one way to use the invention, the second flange body portion 54 is also positionable touching the second box portion, namely side 34*a*. As used in this application, "co-planar" means planes are parallel to one another with one plane lying over the other plane, such as in a stacked deck of cards. Such planes may be next to each other, next to and touching each other, or next to but spaced from each other.

Collection mode 60 also includes the first box portion 20 and the second box portion 30 being rotatable relative to one another about the first hinge 22 from an open collection state 64 to receive waste 18 (FIG. 14) and a closed collection state 66 to trap waste 18 (not specifically shown inside device 10 in the closed state) in between the first box portion 20 and the second box portion 30. In one aspect, the collection mode includes the second hinge 42 positioned next to the second box portion in the closed collection state 66, namely the adjacent edge of elongate second box side 34*a*. In a preferred aspect, the collection mode includes the second hinge 42 and the third hinge 52 positioned next to each other in the closed collection state 66, as seen in FIGS. 6, 8, 9, 10, 12, 13 and 15.

Figure 16:
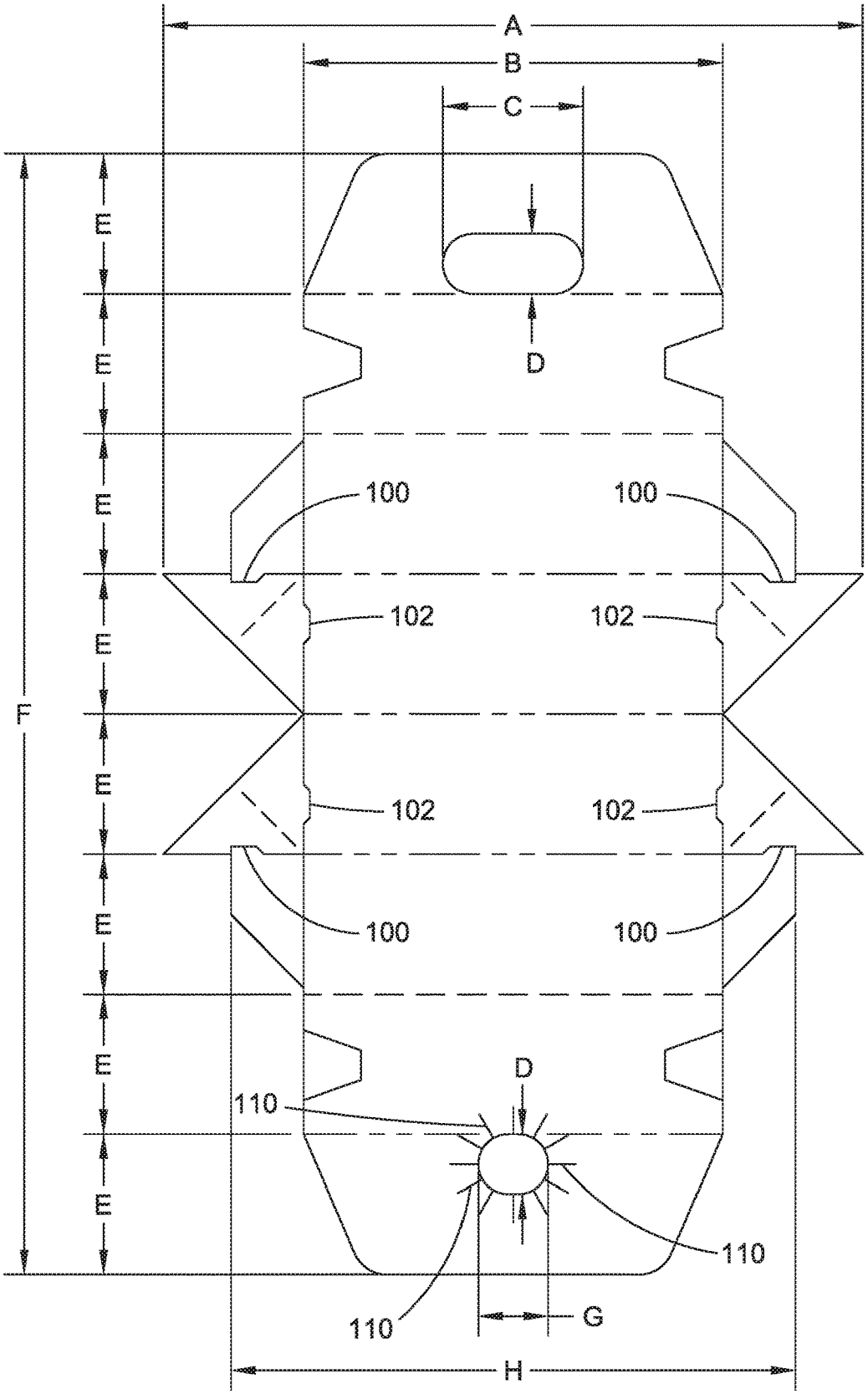
FIG. 16 is top view of a blank of material that can be configured as shown and used to form the invention, and having optional box end tabs to assist the box ends to engage mating elongated box side slots to better enable the first and second box portions to be maintained in the expanded position when desired.

As will be better understood based on use of the invention described below, collection device 10 preferably includes at least one of the first flange end portion 46 and/or the second flange end portion 56, and most preferably both first and second flange end portions 46, 56. The end portion(s) can have a hole 70 located therein and the hole sized to receive one or more finger or thumb therein, for example, a circular hole 72 to accommodate a single finger or a thumb or an oblong or oval hole 74 to accommodate at least two fingers. More preferably, when hole 70 exists, and in particular a hole for both the first and second end portions 46, 56, the first flange end portion hole 74 is sized to receive at least two fingers and the second flange end portion hole 72 is sized to receive a thumb such that the first flange end portion hole is larger than the second flange end portion hole. For example, the hole(s) aid in the collection device 10 being held in one hand 12 and operable between the open collection state 64 and the closed collection state 66 with use of that same hand 12, although the collection device may be operable with the same hand even if the hole(s) are not present but just not as easily and reliably. As seen in FIG. 16, the hole(s) may include slits 110 that expand and contract as the finger(s) and/or thumb is placed therein. This can aid in sizing hole 70 to better accommodate the user's manual manipulation of device 10 more easily and/or reliably, as desired.

Turning to storage mode 80 of collection device 10, the invention includes the first box portion 20 and the second box portion 30 in the collapsed position 82, as seen in FIGS. 1-2. The storage mode refers to the collection device 10 as a group of the same collection devices 10 (e.g., groups of 5, 10, 15, 20, etc.) with them all in the collapsed position 82 before expansion and use of the collection device. As such, the first flange body portion 44 can be positioned co-planar with the second box portion 30. Also, the second flange body portion 54 can be positioned co-planar with the second box portion 30. And, the first flange body portion 44 can be positioned facing and co-planar with the second flange body portion 54. Further, this mode may include the first flange body portion 44 overlying the second box portion 54. Still further, the first box portion 20 may have the pair of elongated first box sides 24, 24*a* and the second box portion may have the pair of elongated second box sides 34, 34*a*. And, the pair of elongated first box sides 24, 24*a* may be co-planar to each other and/or the pair of elongated second box sides 34, 34*a* may be co-planar to each other. In each of these ways, preferably at least one of the first flange body portion 44, second box portion 30, body portion 54, elongated first box sides 24, 24*a* and elongated second box sides 34, 34*a*, are co-planar with at least one other of the listed parts here to better enable a compact orientation of these parts of the device in the storage mode. And, more preferably, at least two, and most preferably all, of these listed parts are co-planar to each other in the storage mode for the same reason.

In a third mode of the collection device it is ready for disposal, that is, putting into a trash can or other place for disposal of the collection device 10 and waste contained therein. In the disposal mode 90, as seen in FIG. 15, the first box portion 20 and the second box portion 30 are in the expanded position 62 and in the closed collection state 66 to trap waste 18 in between the first box portion and the second box portion. The first flange body portion 44 can be positioned facing and co-planar with the second flange body portion 54, and at least one the first flange body portion and the second flange body portion is spaced from at least one of the first box portion 20 and the second box portion 30. Preferably, both the first flange body portion 44 and the second flange body portion 54 are spaced from both the first box portion and the second box portion. In this way, the waste is contained inside the box portions 20, 30 and yet spaced from the hand of the user holding the collection device until ready to be discarded. For example, a particular advantageous feature can be to have the first flange body portion 44 with a tab receptacle 49 and the second flange body portion 54 with a tab 59. Then, soon after positioning body portion 44 facing and co-planar to body portion 54, the tab 59 can be positioned into the tab receptacle 49 to hold the first flange body portion in that facing position to the second flange body portion. Preferably, when using the tab and tab receptacle, they assist to not only hold the first flange body portion facing the second flange body portion, but further to hold the second hinge 42 positioned next to second box portion 30, namely the adjacent edge of elongate second box side 34*a*, in the closed collection state. Further, when the third hinge 52 is part of the collection device too, the tab and tab receptacle assist to hold hinge 42 positioned next to hinge 52 in the closed collection state.

Other optional, and preferred, features of the invention relate to certain configurations and/or orientations. The first box portion 20 and the second box portion 30 may each be one half of a square prism, when a prism is cut, for reference, down its length between opposite vertices. Further, the first box portion 20 may be a mirror image of the second box portion 30 when the box portions 20, 30 are in the expanded position. In another aspect, when in the expanded position 62 the first box portion can have a first box vertex 26 and the second box portion can have a second box vertex 36. Related to this, if desired, the first box vertex 26 can be located between the first hinge 22 and the second hinge 42, and even more desirable, the second box vertex 36 can be located between the first hinge 22 and the third hinge 52 when the collection device includes second flange 50. Also related, and even more desirable, when in the expanded position 62 the first flange end portion 46 may be positioned next to the first box vertex 26. Similarly, when the collection device includes second flange 50, and the collection device is in expanded position 62, the second flange end portion 56 can be positioned next to the second box vertex 36.

The subject invention also includes a method of collecting waste, with a hand operable waste collection device as generally discussed above. In practice, the method includes steps in a variety of orders. At a minimum, desirably certain steps are performed in the following sequential order. First, is providing waste collection device 10 having first box portion 20 joined to second box portion 30 along first hinge 22, the first flange joined to the first box portion along second hinge 42 with first flange body portion 44 extending away from the second hinge. And, when part of the device 10, then second flange 50 joined to the second box portion along third hinge 52 with second flange body portion 54 extending away from the third hinge. Next, expanding the first and second box portions 20, 30 into collection mode 60 where the first hinge and the second hinge are spaced from each other, and if including second flange 50, then the first hinge and the third hinge are spaced from each other. Third, rotating the first flange relative to the first box portion about the second hinge to move the first flange body portion next to the first box portion. Fourth, if including second flange 50, then rotating the second flange body portion relative to the second box portion about the third hinge to move the second flange body portion next to the second box portion. Fifth, rotating the first box portion and the second box portion relative to one another about the first hinge from open collection state 64 to receive waste and closed collection state 66 to trap waste in between the first box portion and the second box portion. Finally, locating the second hinge next to the second box portion (e.g., the adjacent edge of elongate second box side 34*a*) in the closed collection state, or alternately next to the third hinge when flange 50 is part of device 10.

As concerns the third and fourth steps just discussed, additionally or alternatively, the method can include rotating the first flange, and the second flange if included in the collection device, in an arc of at least 100 degrees relative to their respective first or second box portion. Preferably this means the first and second flanges travel in an arc of 0 degrees to 315 degrees, and most preferably travel in an arc of 135 degrees to 315 degrees when in expanded position 62 and through and between open collection state 64 and closed collection state 66.

When a user is operating the collection device, there are several ways the user may position the user's hand when the collection device is in expanded position 62 to cause it to operate and travel through and between open collection state 64 and closed collection state 66. Preferable this can be done using only one hand of the user for rotating the first box portion and the second box portion relative to one another about the first hinge from the open collection state to receive waste and the closed collection state to trap waste in between the first box portion and the second box portion. One way to position the user's hand is as seen in FIGS. 10-13. Thus, the method may include (i) positioning the second flange body portion 54 next to and touching the second box portion 30 and locating a thumb 16 of the user into the circular hole 72 of the second flange end portion and (ii) positioning the first flange body portion 44 next to but spaced from the first box portion 20 and locating at least one finger 14 of the user into the oval hole 74 of the first flange end portion 46 and between the first flange body portion 44 and first box portion 20, namely elongated first box side 24*a*. An alternative hand position is seen in FIGS. 6-9. Here, the method can include (i) positioning the second flange body portion 54 next to and touching the second box portion 30, e.g., elongated side 34*a*, and locating the thumb 16 of the user into the circular hole 72 of the second flange end portion 56 and (ii) positioning the first flange body portion 44 next to and touching the first box portion 20, e.g., elongated side 24*a*, and locating at least one finger 14 of the user into the oval hole 74 of the first flange end portion 46. Yet another aspect of the hand position seen in FIGS. 6-9 includes positioning a different finger 15 of the user against the first hinge 22 and using only one hand of the user for rotating the first box portion 20 and the second box portion 30 relative to one another about the first hinge 22 from the open collection state to receive waste and the closed collection state to trap waste in between the first box portion and the second box portion.

Another aspect to the method of the collection device relates to how it collapses and its compact nature before use of the device 10 to pick up waste. For this, the method can include collapsing the first box portion 20 and the second box portion 30. Preferably this includes positioning the first flange body portion 44 co-planar with at least one of the first box portion 20 and the second box portion 30. And, more preferably, when a second flange exists in the collection device, this includes positioning the second flange body portion 54 co-planar with at least one of the first box portion 20 and the second box portion 30. All this is also described in great detail and degrees of preference above, and applies equally here too.

Still another aspect of the method relates to the disposal mode 90, as seen in FIG. 15. The method can include positioning the first flange body portion 44 next to the second flange body portion 54. And preferably, it then includes spacing first flange body portion 44 and second flange body portion 54 from both the first box portion 20 and the second box portion 30. Related to disposal, other aspects of the method can include providing the first flange body portion 44 with the tab receptacle 49 and the second flange body portion 54 with the tab 59. In operation, this means positioning the tab into the tab receptacle to hold the first flange body portion next to the second flange body portion. And, when a second flange and third hinge are part of the collection device, then the second hinge and the third hinge are positioned next to each other in the closed collection state. The collection device with waste trapped therein is then ready for disposal into the trash, and preferably an environmentally friendly waste disposal system.

Figure 17:
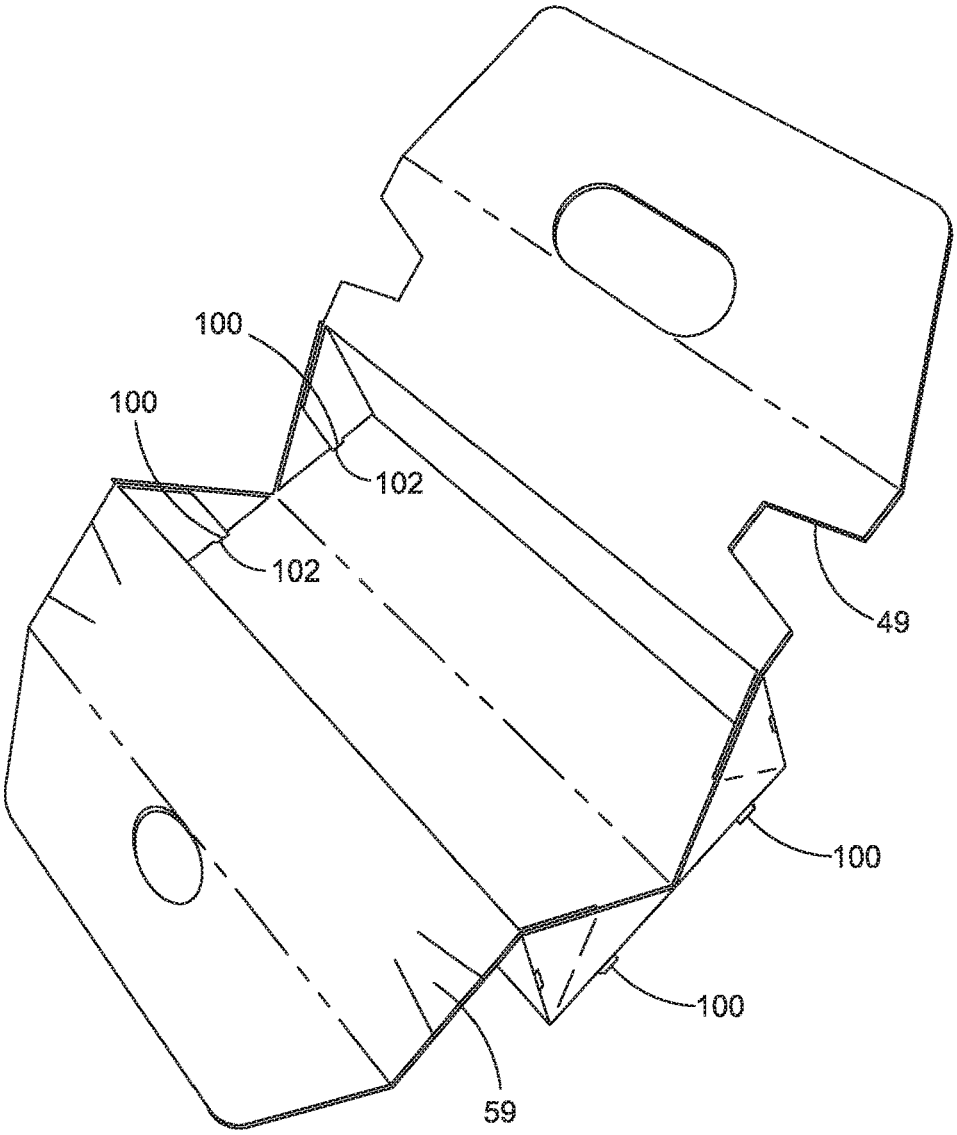
FIG. 17 is the blank of FIG. 16 assembled into an alternate embodiment of the invention having box end tabs and elongated box side slots and positioned similar to FIG. 3; and, FIG. 18 is and end view of the invention seen in FIG. 17 but positioned similar to FIG. 5.
Figure 18:
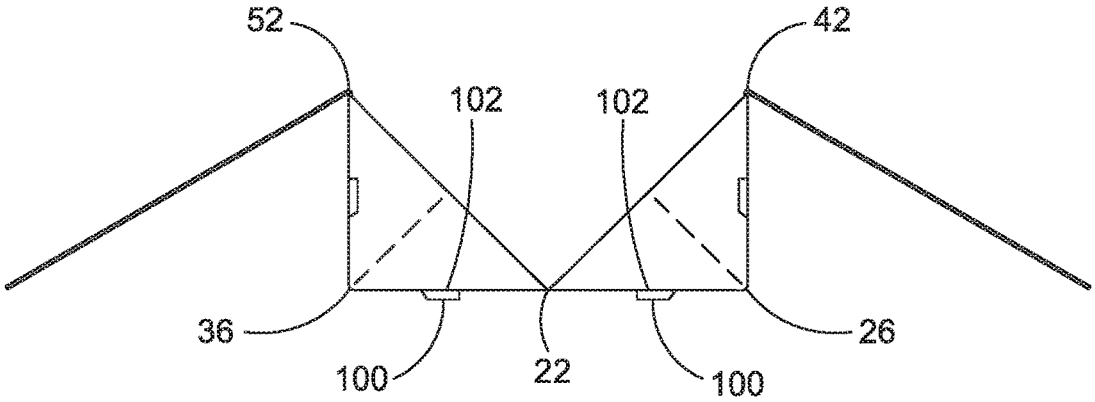

Referring to FIGS. 16-18, there is depicted a blank of material that can be configured as shown and used to form the invention. In this embodiment, the collection device has optional box end tabs 100 to assist the box ends to engage mating elongated box side slots 102 to better enable the first and second box portions to be maintained in the expanded position when desired. FIG. 17 is the blank of FIG. 16 assembled into this embodiment of the invention having box end tabs 100 and elongated box side slots 102 and positioned similar to FIG. 3. FIG. 18 is an end view of that seen in FIG. 17 but positioned similar to FIG. 5. While a variety of dimensions can be used based on the teachings herein, some particularly advantageous ones are noted in FIG. 17, where A=8.7 to 9.5 inches, B=5.25 to 6 inches, C=1.75 inches, D=0.75 inches, E=1.75 to 2 inches, F=14 to 16 inches, G=0.625 to 0.875 inches, and H=7 to 7.75 inches.

The material used to make the waste collection device 10 can be, but is not limited to, paperboard, paper and other fiber based materials, or materials that would act like these in use. The material should have sufficient rigidity to withstand the hand operable forces encountered as would be understood by one of ordinary skill in the art, but preferably not be so rigid that such would detract from ease of recyclability and/or disposal in an environmentally friendly way. The collection device can be a formable paper or a paperboard blank that can be cut, folded and glued or otherwise maintained into the configuration(s) needed to practice the features noted. Paperboard based material preferably has a basis weight of between about 85 g/m2 and about 100 g/m2 and preferably about 93 g/m2, and may have a thickness of between about 0.015 inch and 0.025 inch and preferably about 0.020 to enable reliable use and then enhance environmentally friendly disposal. Rigidity of the material for the device can be adjusted with the basis weight and density. The required rigidity is largely dependent on the application desired and the size of the components of the invention.

As seen in the drawings, hinges can be formed by making lines of weakness at various locations on the blank of material. While any suitable means to make the weakness is well known, some options depicted are score lines that weaken but do not completely penetrate through the material (represented by the short and long dashes in a line, e.g. first hinge 22 and those lines that look like it) and perforations that completely penetrate through the material intermittently (represented by the medium size uniformly dashed lines, e.g. second and third hinges 42, 52 and those lines that look like these). Other lines of weakness can be utilized to help form the collection device and/or enable it to move easily between and through the three modes. Some of these lines of weakness are represented by score lines or perforations, and some are not depicted but would be understood to be employed based on the operation and function of the invention.

Additional Discussion of Embodiments

Embodiment A

There is provided a hand operable waste collection device. The collection device includes a first box portion joined to a second box portion along a first hinge therebetween. The device also includes a first flange joined to the first box portion along a second hinge therebetween, the first flange having a first flange body portion extending away from the second hinge and a first flange end portion outward of the first flange body portion. The device further includes a second flange joined to the second box portion along a third hinge therebetween, the second flange having a second flange body portion extending away from the third hinge and a second flange end portion outward of the second flange body portion. The waste collection device in a collection mode includes (i) the first box portion and the second box portion in an expanded position, (ii) the first hinge and the second hinge spaced from each other and the first hinge and the third hinge spaced from each other, (iii) the first flange body portion positionable facing and co-planar with the first box portion, (iv) the second flange body portion positionable facing and co-planar with the second box portion, (v) the first box portion and the second box portion being rotatable relative to one another about the first hinge from an open collection state to receive waste and a closed collection state to trap waste in between the first box portion and the second box portion, and (vi) the second hinge and the third hinge positioned next to each other in the closed collection state.

Embodiment B

The hand operable waste collection device includes a first box portion joined to a second box portion along a first hinge therebetween. The device also includes a first flange joined to the first box portion along a second hinge therebetween, the first flange having a first flange body portion extending away from the second hinge. The device further includes a second flange joined to the second box portion along a third hinge therebetween, the second flange having a second flange body portion extending away from the third hinge. The waste collection device has a collection mode in which (i) the first box portion and the second box portion are in an expanded position, (ii) the first hinge and the second hinge are spaced from each other and the first hinge and the third hinge are spaced from each other, (iii) the first box portion and the second box portion being rotatable relative to one another about the first hinge from an open collection state to receive waste and a closed collection state to trap waste in between the first box portion and the second box portion, (iv) the first flange body portion is rotatable relative to the first box portion about the second hinge in a first arc of at least 100 degrees to move away from and next to the first box portion, (v) the second flange body portion is rotatable relative to the second box portion about the third hinge in a second arc of at least 100 degrees to move away from and next to the second box portion and (vi) the second hinge and the third hinge are positioned next to each other in the closed collection state.

Embodiment C

The hand operable waste collection device includes a first box portion joined to a second box portion along a first hinge therebetween. The device also includes a first flange joined to the first box portion along a second hinge therebetween, the first flange having a first flange body portion extending away from the second hinge, a first flange end portion being outward of the first flange body portion, a hole located in the first flange end portion and the hole sized to receive one or more finger or thumb therein. The waste collection device in a collection mode includes (i) the first box portion and the second box portion being in an expanded position, (ii) the first hinge and the second hinge being spaced from each other, (iii) the first flange being rotatable about the second hinge to position the first flange body portion next to the first box portion, (iv) the first box portion and the second box portion being rotatable relative to one another about the first hinge from an open collection state to receive waste and a closed collection state to trap waste in between the first box portion and the second box portion, and (v) the second hinge next to the second box portion in the closed collection state.

Embodiment D

The collection device of any of the prior embodiments here, wherein at least one of the first flange end portion and the second flange end portion has a hole located therein and the hole sized to receive one or more finger or thumb therein.

Embodiment E

The collection device of any of the prior embodiments here, wherein the collection device is held in one hand and is operable between the open collection state and the closed collection state with use of that same hand.

Embodiment F

The collection device of any of the prior embodiments here, wherein the first flange body portion is positioned facing and touching the first box portion.

Embodiment G

The collection device of any of the prior embodiments here, wherein the second flange body portion is positioned facing and touching the second box portion.

Embodiment H

The collection device of any of the prior embodiments here, wherein the waste collection device in a storage mode comprises: the first box portion and the second box portion in a collapsed position; the first flange body portion positioned co-planar with the second box portion; the second flange body portion positioned co-planar with the second box portion; and the first flange body portion positioned facing and co-planar with the second flange body portion.

Embodiment I

The collection device of embodiment H, wherein the first flange body portion overlies the second box portion.

Embodiment J

The collection device of embodiment I, wherein the first box portion has a pair of elongated first box sides and the second box portion has a pair of elongated second box sides.

Embodiment K

The collection device of embodiment J, wherein the pair of elongated first box sides are co-planar to each other.

Embodiment L

The collection device of embodiment K, wherein the pair of elongated second box sides are co-planar to each other.

Embodiment M

The collection device of any of the prior embodiments here, wherein the waste collection device in a disposal mode comprises: the first box portion and the second box portion in the expanded position and in the closed collection state to trap waste in between the first box portion and the second box portion; and the first flange body portion positioned facing and co-planar with the second flange body portion and at least one the first flange body portion and the second flange body portion spaced from at least one of the first box portion and the second box portion.

Embodiment N

The collection device of any of embodiment M, wherein both the first flange body portion and the second flange body portion are spaced from both the first box portion and the second box portion.

Embodiment O

The collection device of embodiment N, wherein the first flange body portion has a tab receptacle and the second flange body portion has a tab, and the tab is positioned into the tab receptacle to hold the first flange body portion facing the second flange body portion.

Embodiment P

The collection device of embodiment O, wherein the tab is positioned into the tab receptacle to hold the first flange body portion facing the second flange body portion and further to hold the second hinge and the third hinge positioned next to each other in the closed collection state.

Embodiment Q

The collection device of any of the prior embodiments here, wherein when in the expanded position the first box portion has a first box vertex and the second box portion has a second box vertex.

Embodiment R

The collection device of embodiment Q, wherein the first box vertex is located between the first hinge and the second hinge, and the second box vertex is located between the first hinge and the third hinge.

Embodiment S

The collection device of embodiment R, wherein when in the expanded position the first flange end portion is positioned next to the first box vertex.

Embodiment T

The collection device of embodiment S, wherein when in the expanded position the second flange end portion is positioned next to the second box vertex.

Embodiment U

The collection device of any of the prior embodiments here, wherein the first flange body portion is positioned next to the first box portion when the first box portion and the second box portion are rotatable from the open collection state to the closed collection state.

Embodiment V

The collection device of embodiment U, wherein the second flange body portion is positioned next to the second box portion when the first box portion and the second box portion are rotatable from the open collection state to the closed collection state.

Embodiment W

The collection device of embodiment V, wherein the first flange body portion is positioned next to and touching the first box portion.

Embodiment X

The collection device of embodiment W, wherein at least one of the first flange and the second flange has an end portion outward of the flange body portion.

Embodiment Y

In a different embodiment of the invention there is a method of collecting waste with a hand operable waste collection device. The method includes providing a waste collection device having a first box portion joined to a second box portion along a first hinge therebetween, a first flange joined to the first box portion along a second hinge therebetween with a first flange body portion extending away from the second hinge, and a second flange joined to the second box portion along a third hinge therebetween with a second flange body portion extending away from the third hinge. The method then includes expanding the first box portion and the second box portion into a collection mode where the first hinge and the second hinge are spaced from each other and the first hinge and the third hinge are spaced from each other. Next, the method includes rotating the first flange relative to the first box portion about the second hinge to move the first flange body portion next to the first box portion. And then, the method can include rotating the second flange body portion relative to the second box portion about the third hinge to move the second flange body portion next to the second box portion. After one or both of the prior two steps, then rotating the first box portion and the second box portion relative to one another about the first hinge from an open collection state to receive waste and a closed collection state to trap waste in between the first box portion and the second box portion. Finally, the method includes locating the second hinge and the third hinge next to each other in the closed collection state, thereby trapping the waste inside the collection device.

Embodiment Z

The collection device of embodiment Y, wherein rotating the first flange and the second flange comprises at least one of the first flange and the second flange rotating in an arc of at least 100 degrees relative to their respective first or second box portion.

Embodiment AA

The collection device of any of embodiments Y to Z, wherein each of the first flange and the second flange has an end portion outward of the flange body portion and the first flange end portion has an oval hole located therein sized to receive two fingers and the second flange end portion has a circular hole located therein to receive a thumb.

Embodiment BB

The collection device of embodiment AA, further comprising: positioning the second flange body portion next to and touching the second box portion and locating a thumb of a user into the circular hole of the second flange end portion, and positioning the first flange body portion next to but spaced from the first box portion and locating at least one finger of the user into the oval hole of the first flange end portion and between the first flange body portion and first box portion.

Embodiment CC

The collection device of embodiment AA, further comprising: positioning the second flange body portion next to and touching the second box portion and locating a thumb of a user into the circular hole of the second flange end portion, and positioning the first flange body portion next to and touching the first box portion and locating at least one finger of the user into the oval hole of the first flange end portion.

Embodiment DD

The collection device of embodiment CC further comprising positioning a different finger of the user against the first hinge and using only one hand of the user for rotating the first box portion and the second box portion relative to one another about the first hinge from the open collection state to receive waste and the closed collection state to trap waste in between the first box portion and the second box portion.

Embodiment EE

The collection device of any of embodiments Y to DD, further comprises: collapsing the first box portion and the second box portion, positioning the first flange body portion co-planar with at least one of the first box portion and the second box portion, and positioning the second flange body portion co-planar with at least one of the first box portion and the second box portion.

Embodiment FF

The collection device of any of embodiments Y to EE, wherein locating further comprises: positioning the first flange body portion next to the second flange body portion, and spacing first flange body portion and the second flange body portion from both the first box portion and the second box portion.

Embodiment GG

The collection device of embodiment FF, further comprising: providing the first flange body portion with a tab receptacle and the second flange body portion with a tab, and positioning the tab into the tab receptacle to hold the first flange body portion next to the second flange body portion and the second hinge and the third hinge positioned next to each other in the closed collection state.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the packaging arts, and all such modifications and other embodiments are intended and deemed to be within the scope of the present invention.

What is claimed is:

1. A hand operable waste collection device comprising:

a first box portion joined to a second box portion along a first hinge therebetween;

a first flange joined to the first box portion along a second hinge therebetween, the first flange having a first flange body portion extending away from the second hinge and a first flange end portion outward of the first flange body portion;

a second flange joined to the second box portion along a third hinge therebetween, the second flange having a second flange body portion extending away from the third hinge and a second flange end portion outward of the second flange body portion; and, wherein the waste collection device in a collection mode comprises:

the first box portion and the second box portion in an expanded position;

the first hinge and the second hinge spaced from each other and the first hinge and the third hinge spaced from each other;

the first flange body portion positionable facing and parallel planar with an outside surface of the first box portion;

the second flange body portion positionable facing and parallel planar with an outside surface of the second box portion;

the first box portion and the second box portion being rotatable relative to one another about the first hinge from an open collection state to receive waste and a closed collection state to trap waste in between the first box portion and the second box portion; and the second hinge and the third hinge positioned next to each other in the closed collection state.

2. The collection device of claim 1, wherein at least one of the first flange end portion and the second flange end portion has a hole located therein and the hole sized to receive one or more finger or thumb therein.

3. The collection device of claim 2, wherein a first flange end portion hole is sized to receive at least two fingers and a second flange end portion hole is sized to receive a thumb such that the first flange end portion hole is larger than the second flange end portion hole.

4. The collection device of claim 3, wherein the first flange end portion hole is oblong and the second flange end portion hole is circular.

5. The collection device of claim 1, wherein the collection device is held in one hand and is operable between the open collection state and the closed collection state with use of that same hand.

6. The collection device of claim 1, wherein the first flange body portion is positioned facing and touching the outside surface of the first box portion.

7. The collection device of claim 6, wherein the second flange body portion is positioned facing and touching the outside surface of the second box portion.

8. The collection device of claim 1, wherein the waste collection device in a storage mode comprises:

the first box portion and the second box portion in a collapsed position;

the first flange body portion positioned co-planar with the second box portion;

the second flange body portion positioned co-planar with the second box portion; and the first flange body portion positioned facing and co-planar with the second flange body portion.

9. The collection device of claim 8, wherein the first flange body portion overlies the second box portion.

10. The collection device of claim 8, wherein the first box portion has a pair of elongated first box sides and the second box portion has a pair of elongated second box sides.

11. The collection device of claim 10, wherein the pair of elongated first box sides are co-planar to each other.

12. The collection device of claim 11, wherein the pair of elongated second box sides are co-planar to each other.

13. The collection device of claim 1, wherein the waste collection device in a disposal mode comprises:

the first box portion and the second box portion in the expanded position and in the closed collection state to trap waste in between the first box portion and the second box portion; and the first flange body portion positioned facing and co-planar with the second flange body portion and at least one the first flange body portion and the second flange body portion spaced from at least one of the first box portion and the second box portion.

14. The collection device of claim 13, wherein both the first flange body portion and the second flange body portion are spaced from both the first box portion and the second box portion.

15. The collection device of claim 13, wherein the first flange body portion has a tab receptacle and the second flange body portion has a tab, and the tab is positioned into the tab receptacle to hold the first flange body portion facing the second flange body portion.

16. The collection device of claim 15, wherein the tab is positioned into the tab receptacle to hold the first flange body portion facing the second flange body portion and further to hold the second hinge and the third hinge positioned next to each other in the closed collection state.

17. A hand operable waste collection device comprising:

a first box portion joined to a second box portion along a first hinge therebetween;

a first flange joined to the first box portion along a second hinge therebetween, the first flange having a first flange body portion extending away from the second hinge;

a second flange joined to the second box portion along a third hinge therebetween, the second flange having a second flange body portion extending away from the third hinge; and, wherein the waste collection device in a collection mode comprises:

the first box portion and the second box portion in an expanded position;

the first hinge and the second hinge spaced from each other and the first hinge and the third hinge spaced from each other;

the first box portion and the second box portion being rotatable relative to one another about the first hinge from an open collection state to receive waste and a closed collection state to trap waste in between the first box portion and the second box portion;

the first flange body portion rotatable relative to the first box portion about the second hinge in a first arc of at least 100 degrees to move away from and next to the first box portion;

the second flange body portion rotatable relative to the second box portion about the third hinge in a second arc of at least 100 degrees to move away from and next to the second box portion; and the second hinge and the third hinge positioned next to each other in the closed collection state; and, wherein the waste collection device in a storage mode comprises:

the first box portion and the second box portion in a collapsed position;

the first flange body portion positioned parallel-planar with the second box portion;

the second flange body portion positioned parallel-planar with the second box portion; and the first flange body portion positioned next to and parallel-planar with the second flange body portion.

18. The collection device of claim 17, wherein the first flange body portion is positioned next to the first box portion when the first box portion and the second box portion are rotatable from the open collection state to the closed collection state.

19. The collection device of claim 18, wherein the second flange body portion is positioned next to the second box portion when the first box portion and the second box portion are rotatable from the open collection state to the closed collection state.

20. The collection device of claim 18, wherein the first flange body portion is positioned next to and touching the first box portion.

21. The collection device of claim 17, wherein at least one of the first flange and the second flange has an end portion outward of the flange body portion.

22. The collection device of claim 21, wherein the end portion has a hole located therein and the hole sized to receive one or more finger or thumb therein.

23. The collection device of claim 17, wherein the first box portion has a pair of elongated first box sides and the second box portion has a pair of elongated second box sides and the pair of elongated first box sides are co-planar to each other.

24. The collection device of claim 17, wherein the waste collection device in a disposal mode comprises:

the first box portion and the second box portion in the expanded position and in the closed collection state to trap waste in between the first box portion and the second box portion; and the first flange body portion positioned next to the second flange body portion and the first flange body portion and the second flange body portion are spaced from both the first box portion and the second box portion.

25. The collection device of claim 24, wherein the first flange body portion has a tab receptacle and the second flange body portion has a tab, and the tab is positioned into the tab receptacle to hold the first flange body portion next to the second flange body portion and further to hold the second hinge and the third hinge positioned next to each other in the closed collection state.

26. A hand operable waste collection device comprising:

a first box portion joined to a second box portion along a first hinge therebetween;

a first flange joined to the first box portion along a second hinge therebetween, the first flange having a first flange body portion extending away from the second hinge, a first flange end portion outward of the first flange body portion, a hole located in the first flange end portion and the hole sized to receive one or more finger or thumb therein;

wherein the waste collection device in a collection mode comprises:

the first box portion and the second box portion in an expanded position;

the first hinge and the second hinge spaced from each other;

the first flange rotatable about the second hinge to position the first flange body portion next to an outside surface of the first box portion;

the first box portion and the second box portion being rotatable relative to one another about the first hinge from an open collection state to receive waste and a closed collection state to trap waste in between the first box portion and the second box portion; and the second hinge next to the second box portion in the closed collection state.

27. A method of collecting waste with a hand operable waste collection device comprising:

providing a waste collection device having a first box portion joined to a second box portion along a first hinge therebetween, a first flange joined to the first box portion along a second hinge therebetween with a first flange body portion extending away from the second hinge, and a second flange joined to the second box portion along a third hinge therebetween with a second flange body portion extending away from the third hinge;

expanding the first box portion and the second box portion into a collection mode where the first hinge and the second hinge are spaced from each other and the first hinge and the third hinge are spaced from each other;

rotating the first flange relative to the first box portion about the second hinge to move the first flange body portion next to an outside surface of the first box portion;

rotating the second flange body portion relative to the second box portion about the third hinge to move the second flange body portion next to an outside surface of the second box portion;

rotating the first box portion and the second box portion relative to one another about the first hinge from an open collection state to receive waste and a closed collection state to trap waste in between the first box portion and the second box portion; and locating the second hinge and the third hinge next to each other in the closed collection state.

28. The method of claim 27, wherein rotating the first flange and the second flange comprises at least one of the first flange and the second flange rotating in an arc of at least 100 degrees relative to their respective first or second box portion.

29. The method of claim 28, wherein the arc of at least 100 degrees is an arc of at least 180 degrees.

30. The method of claim 27, wherein at least one of the first flange and the second flange has an end portion outward of the flange body portion and the end portion has a hole located therein and the hole sized to receive one or more finger or thumb therein.

31. The method of claim 27, wherein each of the first flange and the second flange has an end portion outward of the flange body portion and the first flange end portion has an oval hole located therein sized to receive two fingers and the second flange end portion has a circular hole located therein to receive a thumb.

32. The method of claim 31, further comprising:

positioning the second flange body portion next to and touching the second box portion and locating a thumb of a user into the circular hole of the second flange end portion, and positioning the first flange body portion next to but spaced from the first box portion and locating at least one finger of the user into the oval hole of the first flange end portion and between the first flange body portion and first box portion.

33. The method of claim 32 further comprising using only one hand of the user for rotating the first box portion and the second box portion relative to one another about the first hinge from the open collection state to receive waste and the closed collection state to trap waste in between the first box portion and the second box portion.

34. The method of claim 31, further comprising:

positioning the second flange body portion next to and touching the second box portion and locating a thumb of a user into the circular hole of the second flange end portion, and positioning the first flange body portion next to and touching the first box portion and locating at least one finger of the user into the oval hole of the first flange end portion.

35. The method of claim 34 further comprising positioning a different finger of the user against the first hinge and using only one hand of the user for rotating the first box portion and the second box portion relative to one another about the first hinge from the open collection state to receive waste and the closed collection state to trap waste in between the first box portion and the second box portion.

36. The method of claim 27 further comprises:

collapsing the first box portion and the second box portion, positioning the first flange body portion co-planar with at least one of the first box portion and the second box portion, and positioning the second flange body portion co-planar with at least one of the first box portion and the second box portion.

37. The method of claim 36 further comprising positioning the first flange body portion co-planar with the second flange body portion.

38. The method of claim 37 further comprising positioning the first flange body portion co-planar with and overlying the second flange body portion.

39. The method of claim 38, further comprising the first box portion has a pair of elongated first box sides and the second box portion has a pair of elongated second box sides and positioning the pair of elongated first box sides co-planar to each other.

40. The method of claim 27, wherein locating further comprises:

positioning the first flange body portion next to the second flange body portion, and spacing first flange body portion and the second flange body portion from both the first box portion and the second box portion.

41. The method of claim 40, further comprising:

providing the first flange body portion with a tab receptacle and the second flange body portion with a tab, and positioning the tab into the tab receptacle to hold the first flange body portion next to the second flange body portion and the second hinge and the third hinge positioned next to each other in the closed collection state.

42. A hand operable waste collection device comprising:

a first box portion joined to a second box portion along a first hinge therebetween;

a first flange joined to the first box portion along a second hinge therebetween, the first flange having a first flange body portion extending away from the second hinge and a first flange end portion outward of the first flange body portion;

a second flange joined to the second box portion along a third hinge therebetween, the second flange having a second flange body portion extending away from the third hinge and a second flange end portion outward of the second flange body portion; and, wherein the waste collection device in a collection mode comprises:

the first box portion and the second box portion in an expanded position;

the first hinge and the second hinge spaced from each other and the first hinge and the third hinge spaced from each other;

the first flange body portion positionable facing and parallel-planar with the first box portion;

the second flange body portion positionable facing and parallel-planar with the second box portion;

the first box portion and the second box portion being rotatable relative to one another about the first hinge from an open collection state to receive waste and a closed collection state to trap waste in between the first box portion and the second box portion; and the second hinge and the third hinge positioned next to each other in the closed collection state; and, wherein the waste collection device in a storage mode comprises:

the first box portion and the second box portion in a collapsed position;

the first flange body portion positioned parallel-planar with the second box portion;

the second flange body portion positioned parallel-planar with the second box portion; and the first flange body portion positioned facing and parallel-planar with the second flange body portion.

43. The collection device of claim 42, wherein the first flange body portion is positioned facing and touching the first box portion.

44. The collection device of claim 43, wherein the second flange body portion is positioned facing and touching the second box portion.

45. The collection device of claim 42, wherein the waste collection device in a disposal mode comprises:

the first box portion and the second box portion in the expanded position and in the closed collection state to trap waste in between the first box portion and the second box portion; and the first flange body portion positioned facing and parallel-planar with the second flange body portion and at least one the first flange body portion and the second flange body portion spaced from at least one of the first box portion and the second box portion.

46. A method of collecting waste with a hand operable waste collection device comprising:

providing a waste collection device having a first box portion joined to a second box portion along a first hinge therebetween, a first flange joined to the first box portion along a second hinge therebetween with a first flange body portion extending away from the second hinge, and a second flange joined to the second box portion along a third hinge therebetween with a second flange body portion extending away from the third hinge;

expanding the first box portion and the second box portion into a collection mode where the first hinge and the second hinge are spaced from each other and the first hinge and the third hinge are spaced from each other;

rotating the first flange relative to the first box portion about the second hinge to move the first flange body portion next to the first box portion;

rotating the second flange body portion relative to the second box portion about the third hinge to move the second flange body portion next to the second box portion;

rotating the first box portion and the second box portion relative to one another about the first hinge from an open collection state to receive waste and a closed collection state to trap waste in between the first box portion and the second box portion;

locating the second hinge and the third hinge next to each other in the closed collection state;

positioning the first flange body portion next to the second flange body portion; and, spacing the first flange body portion and the second flange body portion from both the first box portion and the second box portion.

47. The method of claim 46 further comprises:

collapsing the first box portion and the second box portion, positioning the first flange body portion parallel-planar with at least one of the first box portion and the second box portion, and positioning the second flange body portion parallel-planar with at least one of the first box portion and the second box portion.

48. The method of claim 47 further comprising positioning the first flange body portion co-planar with the second flange body portion.

49. The method of claim 46, further comprising:

providing the first flange body portion with a tab receptacle and the second flange body portion with a tab, and positioning the tab into the tab receptacle to hold the first flange body portion next to the second flange body portion and the second hinge and the third hinge positioned next to each other in the closed collection state.

50. The method of claim 46, wherein each of the first flange and the second flange has an end portion outward of the flange body portion and the first flange end portion has an oval hole located therein sized to receive two fingers and the second flange end portion has a circular hole located therein to receive a thumb;

positioning the second flange body portion next to and touching the second box portion and locating a thumb of a user into the circular hole of the second flange end portion; and positioning the first flange body portion next to but spaced from the first box portion and locating at least one finger of the user into the oval hole of the first flange end portion and between the first flange body portion and first box portion.

* * * * *